United States Patent [19]

Nadolny et al.

[11] 4,445,236

[45] May 1, 1984

[54] PUSH-THROUGH PUMP

[76] Inventors: Henry Nadolny; Henryka A. Nadolna, both of 5045 N. Mango Ave., Chicago, Ill. 60630

[21] Appl. No.: 464,388

[22] Filed: Feb. 7, 1983

[51] Int. Cl.[3] ..... E03D 11/00

[52] U.S. Cl. ..... 4/255; 4/257

[58] Field of Search ..... 4/255, 256, 257

[56] References Cited

U.S. PATENT DOCUMENTS

| | | | |
|---|---|---|---|
| 2,820,467 | 1/1958 | Mattich | 4/255 X |
| 3,934,280 | 1/1976 | Tancredi | 4/255 |
| 4,053,955 | 10/1977 | Canham | 4/255 |
| 4,097,937 | 7/1978 | Hofmann | 4/255 |
| 4,174,548 | 11/1979 | Dunn | 4/255 X |
| 4,186,451 | 2/1980 | Ruo | 4/255 |

*Primary Examiner*—Henry K. Artis

*Attorney, Agent, or Firm*—John J. Kowalik

[57] ABSTRACT

This invention appertains to plumber's tools for unplugging stoppages in pipes or stacks and comprises a vacuum cup at one end of a handle and a reversible selectively operable pump which is mounted to operate through the cup.

The parts of the mechanism are positionable so that the tool operates as a plunger with a vacuum cup or as a pump.

6 Claims, 4 Drawing Figures

PUSH-THROUGH PUMP

BACKGROUND OF THE INVENTION

The conventional plunger which consists of a vacuum cup at one end of a handle is known. The cup is inserted into a toilet bowl and is alternately pushed and pulled to develop surge pulses on a column of water and thus dislodge the plug in the stack.

The limitations of this tool are apparent in that it is useful only in unplugging or dislodging light plugs. For more difficult situations other tools are used such as snakes or routers. These tools re normally not stocked by the home owner who then calls a plumber at great expense.

SUMMARY OF THE INVENTION

This invention is directed to a novel plumbing tool which in addition to the conventional vacuum cup provides a reversible pump for surging the fluids in a plugged stack back and forth at high pressures which create a trubulence at the plug to loosen the particles of its mass and thus release it so that it will readily flush out.

A primary object of the invention is to provide a novel pump which incorporates a vacuum cup within which is mounted a reversible pump unit for alternately pumping the fluids in opposite directions through the cup which also serves as a seal.

The invention contemplates a novel arrangement of pump and suction cup such that the parts of the mechanism may be juxtaposed in one position so that it may operate as a suction cup and in another position as a pump.

Another object of the invention is to provide a novel pump which may be reversed quickly to alternately pres-urize the fluid column between the pump and the plug and then to depressurize the column to thus loosen the plug.

The invention comprehends a novel pump comprising a pump head which is insertable into a standard toilet and which may be manipulated as a vacuum cup or operated as a pump.

These and other objects and advantages inherent in and encompassed by the invention will become more apparent from the specification and the drawings, wherein.

DESCRIPTION OF THE INVENTION

Figure 1:
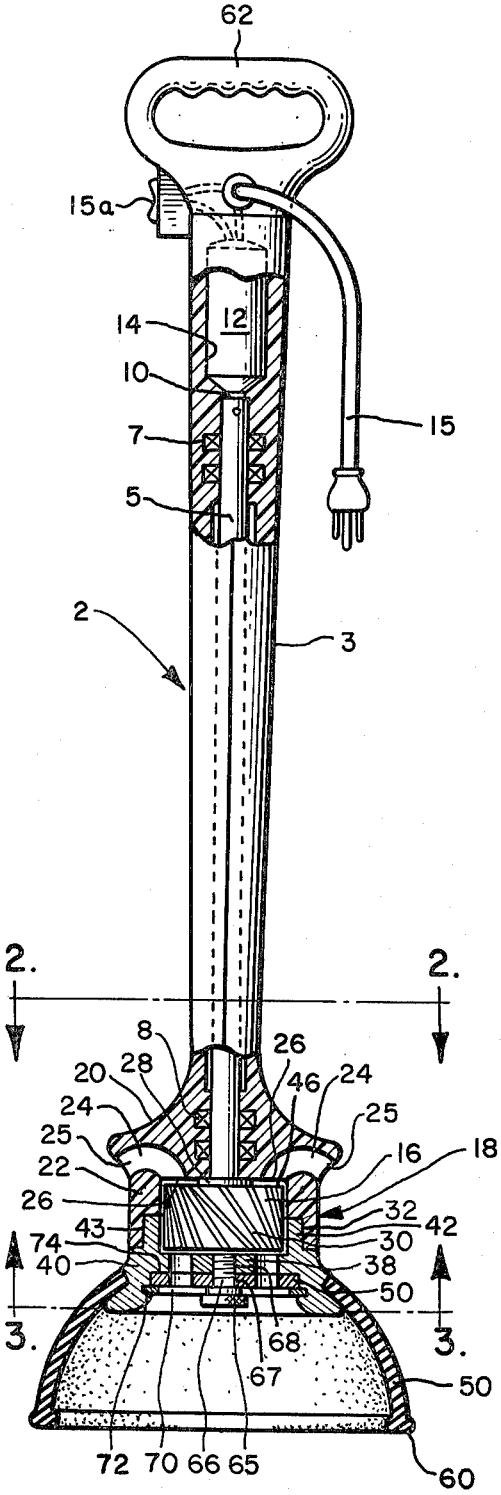
FIG. 1 is a side elevational view of the invention shown partly in axial section.
Figure 2:
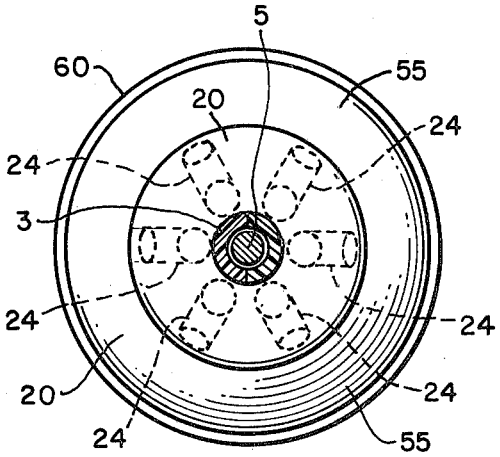
FIG. 2 is an enlarged cross-sectional view taken substantially on line 2—2 of FIG. 1.

Refering to the drawings, the novel pump generally designated 2 comprises a longitudinal body or housing 3 preferably formed of plastic material in two halves and welded or glued together to form a handhold portion. The body encases a drive shaft 5 which is mounted in bearings 7,8 at opposite end of the housing 3.

The upper end of the shaft is connected to a shaft 10 of a reversible electric motor 12 which is confined within a cavity 14 in the upper end of the housing. A reversing switch is connected through a appropriate circuit to a power line 15, by switch 15*a*.

The lower end of the shaft 5 is connected to an impeller rotor 16 which is encased in a housing 18 formed as part of the lower end 20 of the body 3 and comprises an enlarged cylindrical rotor case 22 having a plurality of circumferentially spaced, curved passages 24,24 each having radial open ends 25 and axial open ends 26.

The ends 25 communicate externally of the pump in a location to be immersed in the water in the toilet bowl and the ends 26 communicate with the top side 28 of the pump rotor 16, which has vanes 30 rotatable in the cylindrical portion 32 of the casing 22.

The lower end 34 of rotor 16 opposes the top of a control plate 38 which may be integral with closure annulus 40 having collar 42 secured in bore 43 in casing 22.

The plate 38 has a plurality of axial apertures 44,44 which communicate at their upper ends with the rotor chamber 46. A valve closure plate 50 is below plate 38 and has apertures 52 which are axially alignable with the apertures 44 in plate 38. Plate 50 is adapted to be rotated to a closed position as shown in FIG. 3*a* wherein the holes 44,52 are misaligned or to open position as in FIG. 3 wherein the apertures or openings or ports 44,52 are in alignment.

The mounting ring member 40 has a peripheral groove 54 into which there is fitted the upper end of a vacuum cup 55, the cup 55 being made of elastomer material, such as rubber or neoprene, and has a spinctcral grip on the rim 56 of the ring 40 and is preferably bonded thereto with suitable adhesive. The vacuum cup is of typical design and has a thich lower lip 60, which controls flexing and obtains a good seal.

As is well known the cup is adapted to function as a typical plunger such that upon the tool being grasped by the handle 62 and the body portion 3 and reciprocated within the fluid in a plugged toilet bowl, the cup develops a vacuum and thus pulls on the column of fluid which acts as a hydraulic hammer against the plug to cause it to dislodge and break apart. The plates 38, 50 would be in a closed mode when the tool is used solely as a plunger.

Figure 3:
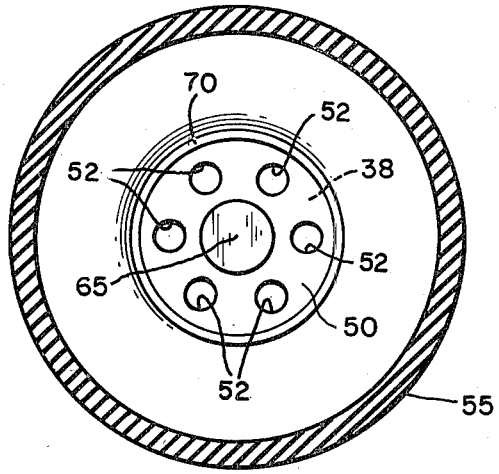
FIG. 3 is an enlarged defined cross-sectional view on line 3—3 of FIG. 1 showing the parts in valve-open pump operating position.
Figure 3A:
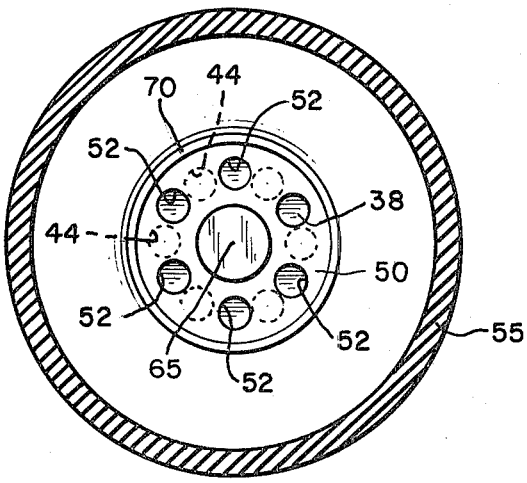
FIG. 3*a* is an illustration of FIG. 3 showing the parts in valve-closed position.

When the tool is used as a pressure or surge pump, the plates are places in the open mode as in FIG. 3. The motor is run in one direction and then switched to the other direction attendant to alternately pressing the switch which reverses the motor rotation and consequently the direction of fluid flow. Fast changes of rotor rotation direction alternately pressurizes the column of fluid and rleases the pressure on the plug. The fluid flows through the opening 44,52.

The plates 38,52 are secured to each other by a bolt 65 which has a shank 66, extending through central openings 67,68 om tje plates, shank 66 being threaded in opening 67 and having a head engaging the bottom side of the plate 50.

A locking ring 70 is expanded into a groove 72 within the rim of the ring member and seats against the peripheral edge of the lower plate 50 which, at its upper edge, bears against a shoulder 74 in the closure ring.

OPERATION OF THE DEVICE

The tool may be conditioned to operate as a plunger by closing the ports 44,52 and the cup is place into the toilet bowland moved back and forth by the handle portion cousing the cup to develop a vacuum. If this does not dislodge the plug then the tool is withdrawn from the bowl and the plates set in open or pumping mode seen in FIGS. 1 and 3. The electric motor would be plugged in and the pump actuated to force the fluid into or out of the stack. The motor could be reversed to alternate the flow of the fluid.

Thus a novel combination plunger and pump has been described in which the parts are positionable to cause the unit to function in either of a plurality of ways in an effective manner.

What is claimed is:

1. A combination pump and plunger for unplugging stoppages in toilets and the like comprising a housing forming a handle portion having a vacuum cup at one end, a pump mounted at said one end of the handle portion within the upper end of the cup, means providing selectively operable openable and closable passage means into said cup and through said pump and out and into said housing for filling and exhausting the pump, and means for reversing said pump, and means for reversing said pump comprising a reversible motor operably connected to the pump.

2. The invention according to claim 1 and said pump comprising a rotor and an enclosing casing, and means providing a mounting for the cup and for said means providing said passage means.

3. The invention according to claim 2 and valve means operably associated with said passage means.

4. The invention according to claim 2 and said motor mounted on the other end of said handle, and drive means within said handle connecting said motor with said rotor.

5. The invention according to claim 1 and said pump comprising a rotor mounted at the base of the cup, and said means providing the openable and closable passage means comprising a valve assembly interposed between the pump and the cup.

6. The invention according to claim 5 and said housing having a sleeve like portion above the rotor with passages therethrough for passing fluid from outside the housing into the pump and for exhausting the fluid out of the housing.

* * * * *